US006136044A

United States Patent [19]

Todd

[11] Patent Number: 6,136,044

[45] Date of Patent: Oct. 24, 2000

[54] STABLE COLORING BY IN SITU FORMATION OF MICRO-PARTICLES

[75] Inventor: William J. Todd, Baton Rouge, La.

[73] Assignee: Board of Supervisors of Louisiana State University and Agricultural and Mechanical College, Baton Rouge, La.

[21] Appl. No.: 09/497,225

[22] Filed: Feb. 3, 2000

Related U.S. Application Data

[60] Provisional application No. 60/198,230, Feb. 3, 1999.

[51] Int. Cl.[7] ..... D06P 1/44; D06P 5/08; D06P 1/653; D06P 1/673; D06L 3/04

[52] U.S. Cl. ..... 8/495; 8/111; 8/443; 8/485; 8/552; 8/558; 8/563; 8/595; 8/596; 8/594; 8/599; 8/607; 8/611; 8/623; 8/624; 8/626; 8/628; 8/635; 8/637.1

[58] Field of Search ..... 8/111, 443, 621, 8/623, 624, 626.8, 635, 595, 596, 637.1, 594, 611, 607, 599, 485, 495, 552–563; 428/372

[56] References Cited

U.S. PATENT DOCUMENTS

| | | | |
|---|---|---|---|
| 60,148 | 12/1866 | Davies | 8/111 |
| 840,264 | 1/1907 | Simon | 8/111 |
| 1,361,139 | 12/1920 | Cole | 8/111 |
| 2,173,474 | 9/1939 | Evoy | 8/111 |
| 2,412,125 | 12/1946 | Conrad | 8/21 |
| 4,145,183 | 3/1979 | Bostwick | 8/111 |
| 4,313,734 | 2/1982 | Leuvering | 23/230 B |
| 4,486,237 | 12/1984 | Paffoni et al. | 106/308 Q |
| 4,657,807 | 4/1987 | Fuerstman | 428/263 |
| 4,775,636 | 10/1988 | Moeremans et al. | 436/518 |
| 4,816,124 | 3/1989 | Manabe et al. | 204/192.14 |
| 4,835,056 | 5/1989 | Sanders et al. | 428/379 |
| 4,859,612 | 8/1989 | Cole et al. | 436/523 |
| 4,927,683 | 5/1990 | Tsutsui | 428/90 |
| 5,089,105 | 2/1992 | Tsutsui | 204/192.14 |
| 5,294,369 | 3/1994 | Shigekawa et al. | 252/313.1 |
| 5,384,073 | 1/1995 | Shigekawa et al. | 252/313.1 |
| 5,403,362 | 4/1995 | Gurley | 8/618 |
| 5,514,602 | 5/1996 | Brooks et al. | 436/525 |
| 5,516,338 | 5/1996 | Pai | 8/596 |
| 5,651,795 | 7/1997 | Gurley | 8/599 |
| 5,795,836 | 8/1998 | Jin et al. | 442/417 |
| 5,861,045 | 1/1999 | Hall | 8/595 |

FOREIGN PATENT DOCUMENTS

| | | |
|---|---|---|
| 3-234882 | 10/1991 | Japan . |
| 4-18178 | 1/1992 | Japan . |
| 4-24293 | 1/1992 | Japan . |

OTHER PUBLICATIONS

AATCC Test Method 16–1993, Colorfastness to Light, option E, AATCC Technical Manual pp. 33–44 (1995).

Bruchez Jr., M. et al., "Semiconductor nanocrystals as fluorescent biological labels," Science, vol. 281, pp. 2013–2015 (1998).

Chan, W.C.W. et al., "Quantum dot bioconjugates for ultrasensitive nonisotopic detection," Science, vol. 218, pp. 2016–2018 (1998).

Collier, B.J. et al., "Ch. 10. Color and Colorfastness," in Textile Testing and Analysis, pp. 197–235, eds. B.J. Collier and H. H. Epps, Prentice–Hall, Inc., New Jersey (1999).

"Elements of Style," Sunday Advocate, Baton Rouge, Louisiana, Jan. 24, 1999, p. 61 (1999).

Hammond, C.R., "The Elements," in CRC Handbook of Chemistry and Physics, 67th Edition (R.C. Weast, ed.), p. B5, B18–19, B39–40, B43 (1986).

Handley, D.A., "Methods for synthesis of colloidal gold," in Colloidal Gold: Principles, Methods, and Applications, vol. 1, M.A. Hayat ed., Academic Press, Inc., New York pp. 14–32 (1989).

Howell, A.B. et al., "Inhibition of the adherence of P–fimbriated *Escherichia coli* to uroepithelial–cell surfaces by proanthocyanidin extracts from cranberries," New England Journal of Medicine, vol. 339, pp. 1085–1086 (1998).

Kuhn, H.H., "Adsorption at the liquid/solid interface: Metal oxide coated textiles," from Book of Papers, 1998 International Conference and Exhibition of American Association of Textile Chemists and Colorists, pp. 281–289 (1998).

Moeremans et al., "Sensitive visualization of antigen–antibody reactions in dot and blot immune overlay assays with immunogold and immunogold/silver staining," J. Immunoligical Methods, vol. 74, p. 353–360 (1984).

Moeremans, M. et al., "Sensitive colloidal metal (gold or silver) staining of protein blots on nitrocellulose membranes," Analytical Biochemisry, vol. 145, pp. 315–321 (1985).

Nakao, Y. et al., "Bleaching of fabrics dyed with fine gold particles," Chem. Abs., vol. 116, ll6:237324k, p. 85 (1992).

Nishizake, T. et al., "Printed fabrics with improved lightfastness and crocking fastness," Chem. Abs., vol. 116, 116:61503b (1992).

Nishizaki, T. et al., "Composition for rapid printing textiles," Chem. Abs., vol. 116, 116:176051v p. 93 (1992).

(List continued on next page.)

*Primary Examiner*—Margaret Einsmann
*Attorney, Agent, or Firm*—Bonnie J. Davis; John H. Runnels

[57] ABSTRACT

Micro-particles of transition metals or their compounds can be generated as an integral part of a fiber by first attaching a nucleating agent to the fiber, and then adding a solution of metal ions. The ions are reduced by the nucleating agent in the fiber, and micro-particles are generated in or on the fiber. Because of the strong color signal resulting from a low concentration of metal micro-particles, the method is cost effective even when using gold or titanium ions. Various colors were generated by changing the size and spacing of the micro-particles, the metal or metal complex used, and the characteristics of the fiber. The dyed fibers displayed colors ranging from pink, red, purple, yellow, orange, peach, brown, gold, silver, grey, green, and black. These colors resisted bleaching by either chemicals or light.

38 Claims, No Drawings

OTHER PUBLICATIONS

Park, K. et al., "Factors affecting the staining with colloidal gold," in Colloidal Gold: Principles, Methods, and Applications, vol. 1, pp. 489–518, M.A. Hayat ed., Academic Press, Inc., New York (1989).

Slot, J.W. et al., "A new method of preparing gold probes for multiple–labeling cytochemistry," European Journal of Cell Biology, vol. 38, pp. 87–93 (1985).

Smit et al., "Colloidal Gold Labels for Immunocytochemical Analysis of Microbes," in Ultrastructure Techniques for Microorganisms, (H.C. Aldrich and W.J. Todd, eds.), p. 469–516 (1986).

Todd, W. et al., "In Situ formation of Metal Sols as Textile Coloring Agents," Textile Chemist & Colorist, vol. 30, p. 39 (1998).

Todd, W. et al., "In Situ formation of Metal Sols as Textile Coloring Agents," Book of Papers, 1998 International Conference & Exhibition, Sep. 22–25, 1998, Philadelphia, Pennsylvania, p. 596.

Turkevich, J. et al., "A Study of the nucleation and growth processes in the synthesis of colloidal gold," Discuss. Faraday Soc., vol. 11, pp. 55–75 (1955)J.

STABLE COLORING BY IN SITU FORMATION OF MICRO-PARTICLES

The benefit of the Feb. 3, 1999 filing date of provisional application No. 60/198,230 is claimed under 35 U.S.C. § 119(e).

This invention pertains to a method to dye fibers by first attaching a nucleating (i.e., reducing) agent to the fiber and then forming insoluble, colored micro-particles at the attachment site of the nucleating agent.

In established methods of dyeing textiles, dye complexes are first formed as colored reagents. These colored reagents are then reacted with fibers of a textile to create a dyed textile. Common mechanisms to attach the pre-formed dyes to the fibers include both the formation of covalent bonds between the dye and the textile and the formation of non-covalent bonds using charge or hydrophobic interactions. The resulting color of the dyed textile has been the same as or similar to that of the colored reagent.

Metals, especially transition elements, are commonly used in the textile industry. The uses include ionic components of organic-metal dye complexes, components of chelating agents to attach dyes to fabrics, and coatings to protect fibers from damage due to photo-bleaching. Metals have been deposited by sputter coating, vacuum deposition, and other methods onto surfaces of textiles to form metallic coatings. See M. Tsutsui, U.S. Pat. No. 4,927,683; M. Tsutsui, U.S. Pat. No. 5,089,105; Manabe et al., U.S. Pat. No. 4,816,124; and M. Fuerstman, U.S. Pat. No. 4,657,807.

Occasionally, metals have been incorporated as pre-formed flakes or particles into the construction of yarns. In these deposition procedures, the appearance of the metal is typically similar to that of the native metal, whether on the surface or within the fabric is typically similar to the native metal; i.e., silver appears as the color of metallic silver and gold appears as the color of metallic gold. Metals attached by such methods are not well integrated into the chemical structure of the fabric, but are adsorbed only on the fiber surface.

In other contexts, it has been observed that when metals are finely divided, a distinct color may result that is different from the color of the metal in bulk. For example, when gold is finely divided, it may appear black, ruby, or purple. C. R. Hammond, "The Elements," in CRC Handbook of Chemistry and Physics, 67th Edition (R. C. Weast, ed.), p. B-18 (1986); and K. Park et al., "Factors affecting the staining with colloidal gold," in Colloidal Gold: Principles, Methods, and Applications, Vol. 1, pp. 489–518, M. A. Hayat ed., Academic Press, Inc., New York (1989). Submicroscopic particles of gold in solution, known as colloid particles or "sols," can have a range of colors including grey, orange, red, or purple, depending upon the size and concentration of the particles. The current procedure to manufacture gold sols is to incubate a mixture of gold ions and a nucleating agent (reducing agent) in an aqueous solution. See J. Smit et al., "Colloidal Gold Labels for Immunocytochemical Analysis of Microbes," in Ultrastructure Techniques for Microorganisms," (H. C. Aldrich and W. J. Todd, eds.), p. 469–516 (1986); and Brooks, Jr. et al., U.S. Pat. No. 5,514,602. Although the exact reaction mechanisms are unclear, the process of sol formation is believed to occur through a reducing event. The gold ions are reduced by the nucleating agent to form a gold micro-particle (a nucleation complex) which increases in size by deposition of metal ions from solution until the metal ions are depleted. Methods to make gold micro-particles may differ depending on the nature of the nucleating agent, pH, temperature, and concentrations of the metal ion or nucleating agent solutions. The type of nucleating agent is important in determining the size and quality of the product. See J. Turkevich et al., "A study of the nucleation and growth processes in the synthesis of colloidal gold," Discuss. Faraday Soc., vol. 11, pp. 55–75 (1955); J. W. Slot et al., "A new method of preparing gold probes for multiple-labeling cytochemistry," European Journal of Cell Biology, vol. 38, pp. 87–93 (1985); and D. A. Handley, "Methods for synthesis of colloidal gold," in Colloidal Gold: Principles, Methods, and Applications, Vol. 1, M. A. Hayat ed., Academic Press, Inc., New York (1989). Once formed, the sol particles can be stably coated with a variety of reagents or polymers, including antibodies or other specific ligands. Such coated sols are extensively used in diagnostic immunological assays as signals to detect and identify antigens. Visual diagnostic signals using gold sols are very sensitive because only a few gold sol particles are required to produce a visually detectable, and often robust, signal. See M. Moeremans et al., "Sensitive colloidal metal (gold or silver) staining of protein blots on nitrocellulose membranes," Analytical Biochemistry, vol. 145, pp. 315–321 (1985); Moeremans et al., "Sensitive visualization of antigen-antibody reactions in dot and blot immune overlay assays with immunogold and immunogold/silver staining," J. Immunological Methods, vol. 74, p. 353–360 (1984); Leuvering, U.S. Pat. No. 4,313,734; Moeremans et al., U.S. Pat. No. 4,775,636; Cole et al., U.S. Pat. No. 4,859,612; Shigekawa et al., U.S. Pat. No. 5,294,369; and Shigekawa et al., U.S. Pat. No. 5,384,073.

The only known method previously used to dye textiles with gold sols uses preformed sol particles that are adsorbed onto the textile fiber. One method simply immerses the fabric in a colloidal gold solution. See Y. Nakao et al., "Bleaching of fabrics dyed with fine gold particles," Chem. Abs., vol. 116, 116:237324k (1992) and Y. Nakao et al., Japanese Pat. No. 4-24293. Another method uses a colloidal gold solution in a textile printing press to dye fabric. See T. Nishizaki et al., "Composition for rapid printing textiles," Chem. Abs., vol. 116, 116:176051v (1992); T. Nishizaki et al., Japanese Pat. No. 4-18178; T. Nishizake et al., "Printed fabrics with improved lightfastness and crocking fastness," Chem. Abs., vol. 116, 116:61503b (1992); and T. Nishizaki et al., Japanese Pat. No. 3-234882.

Iron oxides, which are traditional pigments, are known to form a film on the surface of textiles and to even polymerize on the fiber surface. However, there is no reduction of the iron within the fiber, only a surface adsorption with or without polymerization in a single step process. See H. H. Kuhn, "Adsorption at the liquid/solid interface: Metal oxide coated textiles," from Book of Papers, 1998 International Conference and Exhibition of American Association of Textile Chemists and Colorists, pp. 281–289 (1998).

There is no known prior method to form micro-particles internally in textile fibers.

The production of sol-like particles of more than one metal is currently very difficult and limited in scope due to problems with aggregation. See W. C. W. Chan et al., "Quantum dot bioconjugates for ultrasensitive nonisotopic detection," Science, vol. 218, pp. 2016–2018 (1998); and M. Bruchez Jr. et al., "Semiconductor nanocrystals as fluorescent biological labels," Science, vol. 281, pp. 2013–2015 (1998).

Chemical groups capable of functioning as nucleating agents to reduce metal ions to form sols are already used in the textile industry. Indeed, some of the weaker reducing groups are constituents of some fibers, for example acetate polymers. Reagents capable of forming nucleation reactions possess other properties of importance to the textile industry. The best example is the tannin family of compounds. Tannins are used as mordants in the textile dye industry and are used with soluble metal-containing compounds to form particles in solution that adsorb onto the fibers of the textiles. See Pai, U.S. Pat. No. 5,516,338. The concentration of tannic acid when used as a mordant is typically 15 to 30% by weight depending on the fabric weight.

Metal solutions have also been used as a mordant or otherwise to improve the color produced by a natural or synthetic dye. See Paffini, U.S. Pat. No. 4,486,237; Gurley, U.S. Pat. No. 5,403,362; and Gurley, U.S. Pat. No. 5,631,795.

I have discovered that micro-particles of metals, especially transition elements, or compounds of such metals can be generated as an integral part of a fiber by first attaching a nucleating agent to the fiber, and then adding a solution of metal ions. The ions are reduced by the nucleating agent in the fiber, and micro-particles are generated in or on the fiber. A strong color signal results with a low concentration of metal micro-particles, making the method cost effective even for gold or titanium ions. Various colors were generated by changing the size and spacing of the micro-particles, the metal or metal complex used, and the characteristics of the fiber. The colors produced have included pink, red, purple, yellow, orange, peach, brown, gold, silver, grey, green, and black. Colors so produced resisted bleaching by either chemicals or light.

A two-step method to chemically convert soluble metals into colored micro-particles firmly integrated in the fibers of textiles has been developed. The first step usually was the attachment of a nucleating agent (i.e., a reducing agent), usually by simple absorption and diffusion onto the surface and into the substructure of the fiber of a textile. The second step was to immerse such treated textiles (with the attached nucleating agent) into a solution containing ions of the desired metal. After incubation, colored micro-particles form at the nucleation sites. The extent of particle formation depended on the ability of the nucleating agent to reduce the ions in solution, the concentration of the ions, the temperature, and the duration of the reaction. Additionally, the character of the final color was influenced by the size and spacing of the micro-particles, the chemical composition of the micro-particles, and the composition of the textile fibers. By this two-step method, many unique, attractive colors were formed and proven to be colorfast to both photo- and chemical bleaching.

The term "micro-particle" as used in the specification and the claims is intended to mean a particle formed at the site of the attached nucleation agent by reduction of a soluble form of a metal at that nucleation site; the "micro-particle" may be a particle of a metal, a metal complex, a metal ion, or a polymer nucleus coated with a metal or a metal compound. The micro-particles may be of the metals themselves, complexes with other metals, or compounds of metals such as oxides, hydroxides, salts, and minerals, or of polymer nuclei coated with metals or compounds. Examples of metals useful in practicing this invention include platinum, gold, silver, iron, copper, selenium, chromium, vanadium, titanium, manganese, zirconium, ruthenium, tungsten, palladium, molybdenum, nickel, cobalt, and other transition metals.

Many reagents that are effective as nucleating agents for the formation of micro-particles also possess useful properties for standard dyeing procedures. However, this invention uses these reagents in a different manner and for a different purpose.

The micro-particles of this invention were formed in situ in and around the textile fibers. Initially, the textile was exposed only to the nucleating agent. The nucleating agent infiltrated and attached to the fibers. Only after removing the solution (and optionally drying the textile) was the textile exposed to the metal ion solution. The metal ions infiltrated the fibers, and particles formed at the sites of the nucleating agent. Because the nucleating agent and the metal ions are smaller than a preformed micro-particle, greater penetration into the fiber and substructure of the textile was achieved by this method than by the prior method of preforming the micro-particles before dyeing. The process of forming the micro-particles within the substructure of the fiber also leads to particles more firmly bound to the fiber, presumably because portions of the substructure of the fiber were incorporated into the micro-particle as it formed. Such intimate association of the micro-particle and fiber may explain the variation in color that occurred when the same technique and solutions were applied to different types of fabrics (See Example 2 below). This theory was further supported by the ultrastructure of the micro-particles. (See Example 7 below).

The method of in situ formation allowed the formation of mixed metal alloys and metal coats that are difficult, if not impossible, to achieve in free solution. When micro-particles are formed in free solution, their surface charge is negative and the addition of positive ions will typically result in precipitation. However, when the micro-particles are formed attached to a support, such as a textile fiber, the particle growth and composition can be controlled either by washing out the first metal ion solution and subsequently infiltrating a compatible second metal ion or by infiltrating solutions containing more than one type of metal ion. Reaction mixtures of ions from different metals can be directly applied in a variety of ratios which affects the final color. For example, micro-particles of only vanadium gave a grey-to-black color on silk, while micro-particles of titanium gave a yellow-to-orange color. Unpredictably, when a mixed particle was made of vanadium and titanium, the result was a green color, the shade dependent upon the ratio of vanadium to titanium.

An additional unique factor of this invention was the requirement for low concentrations of reagents. All of the ions of elements and compounds used to form the micro-particles by this in situ method were effective at a concentration of 0.01% W/V, with a range extending at least over the interval of 0.1% to 0.001%. For titanium, a 0.001% solution gave good results, indicating that titanium could be diluted even further. Advantages in using such low concentrations include lower cost, less potential pollution, and lowered exposure to reagents with some toxicity.

Concentration of the nucleating agents was in a range extending at least over the interval of 1% to 0.001% W/V. Although all nucleating agents are reducing agents, not all reducing agents are effective nucleating agents. Additionally, a nucleating agent may be effective only for some metals but not others. For example, sodium citrate and sodium acetate were effective nucleating agents for gold, but not for titanium. Tannic acid at a concentration of 0.1% was effective for all the metals tested and was the most commonly used nucleating agent. To firmly bind the nucleating agent to the fibers, the textile was immersed in the nucleating agent solution for a time which depended on the temperature; i.e., from a few minutes at a boiling temperature to a few hours at an ambient temperatures. Then the textile was typically dried at 60° C. and stored until exposure to the metal ion solution.

The pH of the metal ion solution varied the tone of the color formed, probably by affecting the reduction reaction between the metal ion and the nucleating agent. For example, the gold reaction with tannic acid worked better below pH 6, preferably between pH 3 and 5. The temperature of the reaction also played a role: at higher temperatures (greater than 60° C. to boiling), the nucleation reaction (or micro-particle formation) was faster. Because some of the reagents tended to decompose at high temperatures, most reactions were conducted at ambient temperature.

The colors produced by this invention were also determined by controlling the micro-particle density in the fiber and the size of the micro-particles. When micro-particles are generated in solution from a given element such as gold, the concentration of the chosen nucleating agent primarily controlled the denisty of micro-particle formation; while the size of micro-particles was determined by the concentration of the gold ions relative to the concentration of the nucleating agent. This principle was used in this invention to control micro-particle density and size; i.e., the relative concentration of the nucleating agent and the metal ion was varied to change the resulting color.

A series of experiments was conducted to demonstrate that solutions of transition elements and their soluble complexes could be chemically converted into micro-particles firmly bound to fibers of a textile, and imparting a color to the fiber. Gold was chosen as the prototype element because of the extensive literature on gold sols. Much of the published information on gold, including the effects of pH, the type of solvent, temperature, relative concentrations of reagents, and the nucleating agent, is applicable to the process of making the micro-particles in situ as part of the fibers of textiles. The type of elements or compounds chosen to form the particles was also found to be important. Titanium was chosen for many experiments because it is distant from gold on the periodic table and alloys well with other metals.

The color formed may be the result of forming a pure metal, a metal oxide, or other compound. The character of the color was influenced not only by the metal or metal compound used, but also by the structure and chemistry of the fibers of the fabric.

Prototype experiments were designed to demonstrate the effectiveness of this technique and to determine other variables affecting the in situ micro-particle formation. An extensive range of colors was produced by this method, including but not limited to pink, red violet, purple, yellow, orange, peach, brown, gold, silver, grey, green, and black. The colors produced were shown to be reproducible under the same set of conditions, but colors produced by mixing two or more elements were not predictable based on either intermediate values or "conventional" theories of color combinations.

EXAMPLE 1

Materials and General Method

All chemicals used were obtained from chemical supply houses, such as Sigma Chemical Co., St. Louis, Mo.; Aldrich Chemical Co., Milwaukee, Wis.; Mallinckrodt, Inc., St. Louis, Mo.; J. T. Baker, Inc., Phillipsburg, N.J.; or Alfa AESAR, Woodhall, Mass.

The textiles were all purchased from Testfabrics Inc., Middlesex, N.J. Most tests were performed on AATCC Multifiber Adjacent Fabric, Style 1 (Lot #9464). This test fabric has strips of six different fabrics in the following order: spun acetate, bleached cotton, spun polyacrylamide (nylon 6.6), spun silk, spun vicose, and worsted wool. Larger pieces of certain fiber types used were silk habutae (Lot. #11206, style #609); acetate satin bright (Lot. #73469, Style #100); viscose twill (Lot #7195, Style #212); and TENCEL®, a form of lyocell.

The first step was to incubate the textile in a nucleating agent, usually a 0.1% aqueous solution of tannic acid. The incubation time was sufficient for the nucleating agent to penetrate throughout the fibers of the fabric; e.g., for tannic acid, 30 min with heating to 65° or overnight at room temperature. The incubation method depended on the density of the fiber and the amount of heat the fiber could withstand. After incubation, the textile was removed from the nucleating agent, rinsed in distilled water, and preferably baked dry at about 60° C. for 1 hr. The effective concentration range for most nucleating agents was from about 0.01% to 1% in water, although other solvents such as alcohol were also used in some experiments.

The second step was to immerse the treated textile into a solution containing the chosen metal or compound to generate the color in situ in the fibers. The concentration of the metal was usually about 0.01% W/V in water or other suitable solvent, with an effective range extending at least over the interval from about 0.001% to about 0.1%. The incubation time necessary to produce visible colors varied widely, from a few seconds to overnight. The incubation time depended on the metal ion, the nucleating agent, the temperature, the pH, and the type of fabric. In an alternative embodiment, different metal ions or compounds were mixed prior to immersion of the treated textile. In another alternative embodiment, one ion was first reduced to form a core particle, and then a second ion was added to form a coating on the core.

EXAMPLE 2

Coloring by in situ Nucleation of Gold Ions

A gold solution was prepared by dissolving chloroauric acid (J. T. Baker Inc.; Gold Chloride trihydrate, No. 2146-03) in distilled water and diluting to a final concentration of 0.01% (Unless otherwise noted, all concentrations in all examples are W/V). With chloroauric acid, the final pH of the solution was about pH 4 without adjustment, which was in the desired range of about pH 3.0 to about pH 6.0. Two different nucleating agents were tested, 0.1% tannic acid and 0.1% sodium acetate, in two sets of experiments. The textile sample was a Multifiber Fabric, style 1 (Testfabrics, Inc.) with the six different fabric types as described above in Example 1. In the first experiment, 0.1% tannic acid was the nucleating agent. Initially, the Multifiber fabric was incubated overnight in the tannic acid solution by placing the fabric and solution in a plastic bag placed on a rocker platform at room temperature. The treated textile was then removed, rinsed in distilled water, dried at 60° C., and stored at room temperature.

The dried textile was later immersed in a 0.01% chloroauric acid solution, and again incubated in a plastic bag on the rocker platform at room temperature. After about 4 hr, the reaction was terminated by removing the textile from the gold solution. The dyed textile was rinsed in distilled water and dried. Alternatively, the gold solution and fabric may be heated to near boiling to decrease the incubation time. The colors generated by this technique are given in Table 1.

In the second experiment, an acetate solution (formed by diluting a mixture of equal volumes of 0.2 M acetic acid and 0.2 M sodium acetate) was used as the nucleating agent. The procedure was as described above, except that after incubating in the acetate solution, the textile was not rinsed. The acetate was directly baked on the textile at 60° C. for 1 hr. To generate sufficient color, overnight incubation in 0.01% chloroauric acid was required at room temperature. The visual colors are given in Table 1.

The colors of the different strips were quantified using the CIELAB system of color measurement. See B. J. Collier et al., "Ch. 10. Color and Colorfastness," in Textile Testing and Analysis, pp. 197–235, eds. B. J. Collier and H. H. Epps, Prentice-Hall, Inc., New Jersey (1999). The CIELAB system comprises three scales. The parameter "L*" is a ratio scale measuring lightness/darkness with values ranging from zero (black) to one hundred (white). The "a*" scale ranges from negative infinity (green) to positive infinity (red). The "b*" scale ranges from negative infinity (blue) to positive infinity (yellow). For example, if a sample has an a* value of +20 and a b* value of zero, the sample is red. Conversely, a blue sample would have an a* value of zero and a b* value of +20. However, a purple sample would have a positive a* value and a negative b* value of approximately equal numbers.

The CIELAB color measurements were taken on a Datacolor Spectraflash 500 Colorimeter, DataColor International, with a D65 xenon light, large aperture, 10-degree observer, and specular. The values obtained are given in Table 1. The other two values in Table 1, C* and h°, are derived from the a* and b* values. The parameter "C*" measures the vividness/dullness, with values from zero to infinity. The more positive values indicate a more vivid color. The parameter "h°" measures the hue angle; a value close to 0° indicates a red color; 90°, yellow; 180°, green; and 270°, blue.

Table 1 shows that using acetate as a nucleating agent resulted in lighter colors; i.e., the L* values were higher for all fabric types. By looking at the a* (high positive numbers) and b* values (values close to zero), gold micro-particles tended to dye these fabrics a red to pink color.

TABLE 1

Visual Colors and CIELAB Coordinates of Multifiber Fabric strips after in situ nucleation of gold ions

| FIBER TYPE | COLOR | L* | a* | b* | $C^*_{ab}$ | $h^\circ_{ab}$ |
|---|---|---|---|---|---|---|
| Tannic Acid as Nucleating Agent | | | | | | |
| Spun Diacetate | No color | 57.35 | 7.59 | 1.23 | 7.69 | 9.21 |
| Bleached Cotton | Light Pink | 51.75 | 8.45 | −0.56 | 8.47 | 356.21 |
| Spun Polyamide (Nylon 6.6) | Purple | 43.97 | 11.11 | 0.05 | 11.11 | 0.25 |
| Spun Silk | Red-purple | 43.39 | 12.48 | 1.60 | 12.58 | 7.31 |
| Spun Viscose | Light Pink | 39.30 | 12.17 | −4.05 | 12.83 | 341.58 |
| Worsted Wool | Light Cream | 56.55 | 6.24 | 5.25 | 8.15 | 40.09 |
| Acetate as Nucleating Agent | | | | | | |
| Spun Diacetate | Light Pink | 83.27 | 2.44 | 0 | 2.44 | 0.10 |
| Bleached Cotton | Light Purple | 75.73 | 6.59 | −2.84 | 7.17 | 336.66 |
| Spun Polyamide (Nylon 6.6) | Purple | 61.18 | 7.73 | −3.13 | 8.34 | 337.92 |
| Spun Silk | Dark Red-Purple | 68.81 | 10.50 | 4.68 | 11.50 | 24.04 |
| Spun Viscose | Light Purple | 65.84 | 10.39 | −2.70 | 10.73 | 345.45 |
| Worsted Wool | Light Cream | 79.03 | 1.97 | 13.11 | 13.26 | 81.45 |

Other tannins would also work as nucleating agents. For example, cranberry juice was tried because the juice is known to contain a tannin (proantocyanidin). See A. B. Howell et al., "Inhibition of the adherence of P-fimbriated *Escherichia coli* to uroepithelial-cell surfaces by proanthocyanidin extracts from cranberries," New England Journal of Medicine, vol. 339, pp. 1085–1086 (1998). Cranberry juice proved to be an effective nucleating agent for gold.

EXAMPLE 3

Coloring by in situ Nucleation of Titanium

Using the procedure as described above, titanium was substituted for the gold solution. In most experiments a titanium standard solution (Titanium Atomic Absorption Standard Solution, T-7646, SIGMA Chemical Co, St. Louis, Mo.) was used, but inexpensive titanium salts (e.g., titanium chloride and potassium bis(oxalato)oxotitanate(iv)) were found to give comparable results. Tannic acid (0.1%) was used as the nucleating agent. The concentration of titanium was constant at 0.01%. The results of dyeing the Multifiber Fabric as expressed by visual color and by CIELAB measurements are given in Table 2.

TABLE 2

Visual Color and CIELAB Coordinates of Multifiber Fabric strips after in situ nucleation of titanium

| FIBER TYPE | COLOR | L* | a* | b* | $C^*_{ab}$ | $h^\circ_{ab}$ |
|---|---|---|---|---|---|---|
| Tannic Acid as Nucleating Agent | | | | | | |
| Spun Diacetate | Yellow | 85.80 | 0.54 | 17.86 | 17.87 | 88.25 |
| Bleached Cotton | Yellow | 84.32 | 3.99 | 25.35 | 25.66 | 81.05 |
| Spun Polyamide (Nylon 6.6) | No color | 85.06 | −0.09 | 17.84 | 17.85 | 90.30 |
| Spun Silk | Gold | 69.64 | 12.37 | 49.32 | 50.85 | 75.93 |
| Spun Viscose | Yellow | 80.97 | 5.64 | 30.11 | 30.63 | 79.39 |
| Worsted Wool | Yellow | 75.99 | 4.87 | 34.81 | 35.15 | 82.04 |

A comparison of Table 1 and Table 2 illustrates that different micro-particles formed from different metals imparted different colors to the textiles: gold tended to color cloth with a pink or red shade, and titanium, a yellow shade.

EXAMPLE 4

Effects of Process Variations on Coloring with Titanium

The process steps were varied to find ways to intensify or change the coloring effects of titanium for different fabrics. The Multifiber Fabric dyed by the procedure in Example 3 was used as a control. The visual colors produced by each procedure were noted. Additionally, the color differences between each procedure and the control were calculated by the following method. The difference in color can be determined by subtracting the values for the two fabrics; i.e., $\Delta L^*=L_1-L_2$, where Δ(delta) means difference and $L_1$ and $L_2$ are the L* values for the two fabrics. In a similar manner, Δa* and Δb* can be calculated. Moreover, the overall color difference between two specimens can be designated by a single value, ΔE*, a term which incorporates the differences in the individual terms, L*, a*, and b*. This term ΔE* is calculated using the following formula:

$$\Delta E^*=(\Delta L^2+\Delta a^2+\Delta b^2)^{1/3}$$

An additional parameter, ΔK, the Kubelka-Munk coefficient of absorption, was measured to indicate the differences in absorption of light between the two samples. These values are given in Table 3 for the following procedures:

Procedure 1: Addition of Zirconium

The addition of zirconium was tested because of its high refractivity. Zirconium (zirconyl chloride; Sigma-Aldrich, No. Z-1875) (0.05%) was added to the 0.01% aqueous titanium solution. Multifiber Fabric sample was colored as described in Example 3. As seen in Table 3, only spun viscose showed a large color difference, $\Delta E^*=20.27$. This difference was seen visually as a change from yellow to a gold color.

Procedure 2: Pretreatment with Polyethylenimine (PE)

To test whether a mordant would affect binding of the tannic acid to negatively charged fiber types, the positively charged polymer polyethylenimine was tested. The Multifiber Fabric was pretreated with a 0.1% aqueous polyethylenimine (PE) solution by incubating at 60° for 1 hr. The fabric was then rinsed with $dH_2O$ and incubated in 0.1% tannic acid overnight at room temperature. Then the textile was rinsed with $dH_2O$ again and dried at 60° C. The textile was then placed in a 0.01% titanium solution and incubated for 2 hr at room temperature. The color differences between the fabric from Example 3 and the fabric pretreated with PE are seen in Table 3. A large increase in intensity was seen in all fiber types except the spun silk. Similar increases were seen when the PE solution was replaced with a 0.1% aqueous polylysine-solution.

Procedure 3: Using an Alcohol Solution of Titanium

To test the effectiveness of non-aqueous solvents, ethanol was used instead of water. The procedure as described in Example 3 was followed except that a 0.1% aqueous titanium solution was diluted to a final titanium concentration of 0.01% with 95% ethanol. The color differences are listed in Table 3. The major differences were seen in the $\Delta E^*$ values of spun polyamide (nylon) and spun viscose, both showing a more intense color.

Procedure 4: Boiling the Fabric with the Nucleating Agent; Using an Alcohol Solution of Titanium To test whether boiling would increase the penetration of the nucleating agent into the fibers of the fabric, Procedure 3 above was repeated, except that the fabric was boiled in the tannic acid solution for 30 min. The color differences between this fabric and the fabric from Example 3 are seen in Table 3. Large increases in color density as indicated by the visual color changes and the value of $\Delta E^*$ were seen in spun polyamide (nylon), silk, and worsted wool. Visually, the nylon changed from no color to peach (light yellow-orange), the silk from yellow to dark gold, and the wool from yellow to gold.

Thus different protocols may be used depending on the fiber type to intensify the color obtained from the in situ formation of micro-particles.

TABLE 3

Effects of Various Protocols on Colors Produced with Titanium

| FIBER TYPE | COLOR | $\Delta E^*$ | $\Delta L^*$ | $\Delta a^*$ | $\Delta b^*$ | $\Delta C^*$ | $\Delta K^\circ$ |
|---|---|---|---|---|---|---|---|
| Spun Diacetate | | | | | | | |
| Ti + Zr | Cream | 3.69 | −0.97 | 2.19 | 2.81 | 2.98 | −1.95 |
| PE Pretreatment | Yellow | 21.08 | −5.67 | 6.46 | 19.24 | 19.89 | −4.05 |
| Ti + EtOH | No color | 6.07 | 3.10 | −1.01 | −5.12 | −5.12 | 1.01 |
| Ti + EtOH + Boiling | Yellow | 4.94 | −0.18 | −0.86 | 4.86 | 4.86 | 0.89 |
| Bleached Cotton | | | | | | | |
| Ti + Zr | Yellow | 8.87 | −4.47 | 4.16 | 6.42 | 7.14 | −2.76 |
| PE Pretreatment | Gold | 46.01 | −21.55 | 20.81 | 34.92 | 39.51 | −9.56 |
| Ti + EtOH | Yellow | 15.26 | 4.30 | 4.46 | 13.95 | 14.53 | −1.79 |
| Ti + EtOH + Boiling | Cream | 6.61 | 2.32 | −3.81 | −4.88 | −5.19 | 3.37 |
| Spun Polyamide (Nylon 6.6) | | | | | | | |
| Ti + Zr | Pale cream | 3.53 | −1.05 | 0.86 | 3.26 | 3.27 | 0.81 |
| PE Pretreatment | Yellow | 21.27 | −3.16 | 3.69 | 20.71 | 20.88 | −2.58 |
| Ti + EtOH | Yellow | 24.12 | −6.45 | 8.31 | 21.70 | 22.54 | −5.63 |
| Ti + EtOH + Boiling | Pale yellow-orange | 19.82 | −10.05 | 8.54 | 14.81 | 15.88 | −6.32 |
| Spun Silk | | | | | | | |
| Ti + Zr | Dark gold | 5.86 | −4.06 | 3.57 | −2.25 | −1.15 | −4.06 |
| PE Pretreatment | Gold-Yellow | 8.60 | −0.58 | 2.84 | 8.10 | 8.55 | −0.72 |
| Ti + EtOH | Yellow-gold | 3.63 | −0.78 | 2.11 | 2.85 | 3.29 | −1.31 |
| Ti + EtOH + Boiling | Dark gold | 11.38 | −1.10 | 1.97 | −11.15 | −10.08 | −5.17 |
| Spun Viscose | | | | | | | |
| Ti + Zr | Gold | 20.27 | −13.00 | 10.14 | 11.79 | 14.14 | −6.47 |
| PE Pretreatment | Gold | 48.05 | −20.18 | 22.38 | 37.42 | 42.48 | −9.83 |
| Ti + EtOH | Yellow-gold | 19.20 | −8.73 | 9.39 | 14.29 | 16.24 | −5.35 |
| Ti + EtOH + Boiling | Yellow | 3.26 | 0.90 | −2.22 | 2.21 | 1.87 | 2.51 |

TABLE 3-continued

Effects of Various Protocols on Colors Produced with Titanium

| FIBER TYPE | COLOR | ΔE* | ΔL* | Δa* | Δb* | ΔC* | ΔK° |
|---|---|---|---|---|---|---|---|
| Worsted Wool | | | | | | | |
| Ti + Zr | Yellow | 2.72 | −1.80 | 1.99 | −0.44 | −0.10 | −2.03 |
| PE Pretreatment | Light Gold | 21.89 | −5.66 | 9.50 | 18.89 | 20.44 | −5.41 |
| Ti + EtOH | Yellow | 12.21 | −1.85 | 4.11 | 11.35 | 11.88 | −2.16 |
| Ti + EtOH + Boiling | Gold | 35.15 | −15.73 | 18.91 | 25.10 | 29.31 | −11.35 |

EXAMPLE 5

Colors Generated with Other Elements

Other metals were used to generate micro-particles on textile fibers, producing a myriad of colors. The procedure was as described above for Example 2: the nucleating agent was 0.1% tannic acid and the metal concentration was 0.01%. Results are given in Table 4.

TABLE 4

Visual Colors Produced Using Individual Transition Metals, One at a Time

| ELEMENT | Spun acetate | Bleached cotton | Spun polyamide | Spun silk | Spun viscose | Worsted wool |
|---|---|---|---|---|---|---|
| Gold (Chloroauric acid) | Light purple | Light purple | Purple | Dark red | Purple | Light Purple |
| Copper (Cupric sulfate) | Cream | Dark cream | Cream | Cream | Yellow-cream | No color |
| Vanadium (Vanadium tribromide) | Silver-gray | Gray | Light gray | Dark-gray | Gray | Gray |
| Vanadium (Vanadium sulfate oxide) | Light gray | Gray | Light gray | Dark-gray | Gray | Light gray |
| Iron (Ferric sulfate) | Light gray | Gray | Light gray | Gray | Dark gray | Light gray |
| Iron (Ferrous sulfate) | Light gray | Gray | Gray | Dark gray | Gray | Gray |
| Iron (Ferric chloride) | Light gray | Gray | Gray | Silver-gray | Dark gray | Gray |
| Copper (Cupric acetate) | Cream | Brown | Cream | Green | Brown | Green |
| Ruthenium (Ruthenium trichloride) | Gray | Green-gray | Gray | Brown-gray | Green-gray | Gray |
| Platinum (Platinic chloride) | No color | No color | No color | Cream | Cream | Yellow-green |
| Silver (Silver nitrate) | Cream | Gray | Brown | Cream | Brown | Brown |
| Chromium (Sodium dichromate) | Light cream | Dark cream | Cream | Brown-green | Dark cream | Taupe |
| Chromium (Ammonium dichromate) | Light cream | Dark cream | Cream | Brown-green | Dark cream | Taupe |
| Molybdenum (Ammonium molybdate) | Light yellow | Yellow | Light yellow | Yellow-gold | Yellow | Pale yellow |
| Palladium (Palladium chloride) | Beige | Beige | Beige | Yellow-cream | Light brown | Pale brown |

EXAMPLE 6

Coloring with Combinations of Elements

Using the procedure of Example 2 and maintaining a constant 0.1% tannic acid as the nucleating agent to treat Multifiber Fabrics, combinations of metals were tested to see what colors could be generated.

Procedure 1 Simultaneous Combination of Two Metals

The fabric was treated with 0.1% tannic acid for 30 min at 65°, then dried for 1 hr at 60°, and then either used immediately or stored until use. The dried fabric was placed in a single solution which contained the two metals of interest. The combinations and concentrations of metals tested were as follows:

a. Titanium and Gold

A solution of 0.01% titanium and 0.01% chloroauric acid was incubated with the Multifiber Fabric at 25° for 2 hr. The colors seen in the various fabrics are given in Table 5.

b. Chromium and Gold

A solution of 0.01% sodium dichromate and 0.01% chloroauric acid was incubated with the Multifiber Fabric at 25° for 1 hr. The colors seen in the various fabrics are given in Table 5.

c. Tungsten and Gold

A solution of 0.01% sodium tungstate(VI) and 0.01% chloroauric acid was incubated with the Multifiber Fabric at 25° for 1 hr. The colors seen in the various fabrics are given in Table 5.

d. Ruthenium and Gold

A solution of 0.01% ruthenium chloride and 0.01% chloroauric acid was incubated with the Multifiber Fabric at 25° for 1 hr. The colors seen in the various fabrics are given in Table 5.

e. Iron and Gold

A solution of 0.01% ferric chloride and 0.01% chloroauric acid was incubated with the Multifiber Fabric at 25° for 1 hr. The colors seen in the various fabrics are given in Table 5.

f. Titanium and Vanadium

A solution of 0.01% titanium and 0.01% vanadium tribromide was incubated with the Multifiber Fabric at 25° for 1 hr. The colors seen in the various fabrics are given in Table 5.

g. Titanium and Zirconium

A solution of 0.01% titanium and 0.05% zirconyl chloride was incubated with the Multifiber Fabric at 25° for 2 hr. The colors seen in the various fabrics are given in Table 5.

Procedure 2 Sequential Combination of Two Metals

The Multifiber Fabric strip was treated with 0.1% tannic acid for 30 min at 65°, then dried for 1 hr at 60°, and then either used immediately or stored until use. The dried fabric was incubated in a solution with one metal for a set time, removed and immediately then incubated in another solution containing the second metal. The combinations of metals and incubation times were as follows:

a. Titanium and Palladium

The Multifiber Fabric was first incubated in an aqueous 0.005% titanium dichloride solution for 30 min at 25°. The fabric was then transferred into an aqueous 0.01% palladium chloride solution and was incubated at 25° for 2 hr. The colors seen in the various fabrics are given in Table 5.

b. Ruthenium and Chromium

The Multifiber Fabric was first incubated in an aqueous 0.01% ruthenium trichloride solution for 30 min at 25°. The fabric was then transferred into an aqueous 0.01% ammonium dichromate solution and was incubated at 25° for 2 hr. The colors seen in the various fabrics are given in Table 5.

c. Iron and Chromium

The Multifiber Fabric was first incubated in an aqueous 0.05% ferric chloride solution for 5–7 min at 25°. The fabric was then transferred into an aqueous 0.01% ammonium dichromate solution and was incubated at 25° for 1.75 hr. The colors seen in the various fabrics are given in Table 5.

d. Iron and Molybdenum

The Multifiber Fabric was first incubated in an aqueous 0.05% ferric chloride solution for 5–7 min at 25°. The fabric was then transferred into an aqueous 0.01% molybdenum dichloride dioxide solution and was incubated at 25° for 1.75 hr. The colors seen in the various fabrics are given in Table 5.

e. Molybdenum and Ruthenium

The Multifiber Fabric was first incubated in an aqueous 0.01% ruthenium chloride solution for 30 min at 25°. The fabric was then transferred into an aqueous 0.01% molybdenum dichloride dioxide solution and was incubated at 25° for 2 hr. The colors seen in the various fabrics are given in Table 5.

f. Molybdenum and Palladium

The Multifiber Fabric was first incubated in an aqueous 0.01% molybdenum dichloride dioxide solution for 2 hr at 25°. The fabric was then transferred into an aqueous 0.01% palladium chloride solution and was incubated at 25° overnight. The colors seen in the various fabrics are given in Table 5.

Procedure 3 Combination of Three Metals

The fabric was treated with 0.1% tannic acid for 30 min at 65°, then dried for 1 hr at 60°, and either used immediately or stored until use. The dried fabric was then incubated either with all metals at once or in a sequence of metals as described below:

a. Titanium, Zirconium, and Gold (in Alcohol)

The Multifiber Fabric was first incubated in an aqueous solution comprising 0.01% titanium and 0.05% zirconyl chloride for 30 min at 25°. The fabric was then transferred into a 0.01% chloroauric acid solution in 47% ethanol overnight at 25°. The colors seen in the various fabrics are given in Table 5.

b. Titanium, Zirconium, and Ruthenium

The Multifiber Fabric was first incubated in an aqueous solution comprising 0.01% titanium and 0.05% zirconyl chloride for 1 hr at 25°. The fabric was then transferred into a 0.01% ruthenium chloride solution for 1 hr at 25°. The colors seen in the various fabrics are given in Table 5.

c. Vanadium, Titanium, and Zirconium

Samples of silk habutae and acetate satin bright were each incubated in an aqueous solution containing 0.01% titanium, 0.01% zirconyl chloride, and 0.04% vanadium tribromide for 1 hr at 25°. The color generated on both fabric types was green. The intensity and hue of the green could be changed by varying the ratios of the ions and the time of incubation. The visual colors ranged from grey-green to yellow-green.

TABLE 5

Visual Colors Produced Using Combinations of Two or Three Transition Metals

| ELEMENTS | Spun acetate | Bleached cotton | Spun polyamide | Spun silk | Spun viscose | Worsted wool |
|---|---|---|---|---|---|---|
| A. Two metals silmultaneously | | | | | | |
| Titanium and Gold | Pale brown | Light pink | Purple | Rust-brown | Light purple | Tan |
| Chromium and Gold | Light purple | Purple | Purple | Brown | Purple | Green |
| Tungsten and Gold | Light pink | No color | No color | No color | Pink | No color |
| Ruthenium and Gold | Light gray | Green | Gray | Green | Green | Light gray |
| Iron and Gold | Brown | Brown | Purple | Dark Brown | Brown | No color |
| Titanium and Vanadium | Cream | Cream | Pale green | Green | Cream | Cream |
| Titanium and Zirconium | Yellow | Yellow | Pale yellow | Dark gold | Gold | Yellow |
| B: Two metals sequentially | | | | | | |
| Titanium and Palladium | Cream | Beige | Cream | Gold | Dark beige | Cream |
| Ruthenium and Chromium | No color | No color | No color | Green-brown | Cream | Light green |
| Iron and Chromium | Light gray | Gray | Light gray-green | Green | Gray | Green |
| Iron and Molybdenum | No color | Gray | Light gray-green | Green | Gray | No color |
| Molybdenum and Ruthenium | Light gray | Dark gray | Light gray | Green | Gray | No color |
| Molybdenum and Palladium | Beige | Beige | Beige | Yellow-cream | Light brown | Light brown |
| C: Three metals | | | | | | |
| Titanium, Zirconium and Gold | Green-Beige | Yellow-brown | Purple | Yellow | Gold | Beige |
| Titanium, Zirconium and Gold Ruthenium | Light gray-green | Gray | Light gray | Gold | Green | Light green |

EXAMPLE 7

Possible Oxidation of Micro-Particles Attached to Fibers

To test for possible oxidation of metals after deposition on the fibers, a Multifiber Fabric was dyed using titanium, zirconium, and gold as described above in Example 6, Procedure 3a, and then placed in a 3% hydrogen peroxide solution overnight. The fibers of spun diacetate and spun acrylamide did not change color. The other fibers changed colors as follows: cotton changed from yellow-brown to light purple; spun silk, from yellow to green; spun vicose, from gold to light purple; and worsted wool, from beige to light purple beige. Thus hydrogen peroxide was able to change the hue of the fabric color after the deposition of the micro-particles, when ethanol was used in the solvent for the gold overlay. In an earlier experiment using an aqueous gold solution, the hydrogen peroxide did not change the color of any of the fibers.

EXAMPLE 8

Ultrastructure of In Situ Gold Micro-Particles in Fibers of Viscose and Silk Swatches of silk habutae (style #609) and viscose twill (style #212) were colored with 0.01% chloroauric acid using 0.1% tannic acid as the nucleating agent, as described in Example 2. After coloration, a small piece of each fabric was embedded in a resin of Epon/Araldite. Ultrathin sections were made with a diamond knife; and the sections stained for 5 min using 5% uranyl acetate, pH 3.5, followed by lead citrate, as described by E. S. Reynolds, "The use of lead citrate at high pH as an electron opaque stain in electron microscopy," J. Cell Biol., vol. 17, pp. 208–212 (1963). The electron dense stain was used to study the relationship between the particles and the textile fibers. After staining, the slices were examined under a Zeiss EM-10 electron microscope. Discrete electron dense gold particles were found dispersed throughout the fibers of both the silk and the viscose rayon. The gold particles seen were more irregular in shape and more varied in size than gold particles formed in solutions as sols.

The electron micrographs confirmed that the micro-particles had become an integral part of the fiber. For example, the irregular features of the micro-particles often appeared to be closely associated with and continuous with the fibers; and the micro-particles were seen scattered throughout the substructure of the fibers, indicating good penetration of the reagents into the fibers. The approximate size range of the particles formed within the fibers was from about 5 to 80 nm in diameter. The particles formed throughout the silk fibers were smaller and in greater numbers than those formed throughout the vicose fibers.

EXAMPLE 9

Colorfastness to Light

Sample strips, 125 mm×65 mm, of silk habutae (style #609), vicose twill (style #212) and TENCEL®, a form of lyocell, were colored with the techniques as described above in Examples 1 and 2. In all the following cases, the concentration of the metal solution was 0.01%. Three samples of silk were tested: one dyed with titanium, one with chromium, and one without color. Four samples of viscose were tested: one dyed with gold; one with titanium; one with platinum; and one without color. Two samples of TENCEL® were tested: one colored with a combination of titanium and zirconium; and one without color. The sources of all fabrics and chemicals are as described in Example 1. After dyeing, the CIELAB Coordinates of all samples were measured and are shown in Table 6, part I.

All samples were then tested for colorfastness to light according to the procedure described in AATCC Test Method 16-1993, Colorfastness to Light, option E, AATCC Technical Manual (1995). Fabrics were exposed to continuous light for up to 60 hr, at 1.10 $W/m^2/nm$ at 420 nm in a water cooled, xenon lamp weatherometer. The black panel temperature was 63° C., dry bulb temperature was 43° C., and relative humidity was controlled at 30%. The outer filter was soda lime, and the inner filter was borosilicate. An L4 AATCC Blue Wool Lightfastness Standard was exposed under the same conditions.

At 20 hr, 40 hr, and 60 hr of light exposure, the samples were measured for colorfastness. Three sets of values were measured. The first set was another measurement of the CIELAB coordinates for color differences, $\Delta E^*$ as described above in Example 4. These values are shown in Table 6, part II. The CIELAB coordinates were not measured for the blue wool standard. The greatest color difference, $\Delta E^*=2.96$, was seen for TENCEL®, colored with titanium and zirconium. This is still considered a minor difference in color.

TABLE 6

I. PRE EXPOSURE CIELAB COORDINATES

| Fabric | Treatment | Color | $L^*$ | $a^*$ | $b^*$ | $C^*_{ab}$ | $h^*_{ab}$ |
|---|---|---|---|---|---|---|---|
| Silk | None | White | 92.27 | −0.27 | 4.65 | 4.66 | 93.33 |
| | Cr | Lt. Brown | 68.12 | 6.09 | 32.86 | 33.42 | 79.50 |
| | Ti | Dk. Yellow | 70.98 | 15.53 | 58.93 | 60.94 | 75.24 |
| Viscose | None | White | 91.81 | −0.03 | 4.87 | 4.87 | 90.34 |
| | Au | Purple | 43.33 | 15.88 | −4.90 | 16.62 | 342.86 |
| | Pt | White | 91.89 | −0.10 | 4.80 | 4.80 | 91.15 |
| | Ti | Lt. Yellow | 88.61 | −0.91 | 22.57 | 22.58 | 92.31 |
| TENCEL ® | None | White | 87.94 | 1.55 | 8.68 | 8.81 | 79.89 |
| | Ti/Zr | Lt. Orange | 78.47 | 8.29 | 33.10 | 34.13 | 75.93 |

II. COLOR DIFFERENCES ($\Delta E^*$) AFTER EXPOSURE TO LIGHT

| Fabric | Treatment | 20 Hour | 40 Hour | 60 Hour |
|---|---|---|---|---|
| Silk | None | 0.55 | 2.14 | 1.22 |
| | Cr | 1.22 | 2.23 | 2.02 |
| | Ti | 1.74 | 2.85 | 2.49 |
| Viscose | None | 0.49 | 2.24 | 1.41 |
| | Au | 0.95 | 0.92 | 0.64 |
| | Pt | 0.32 | 2.61 | 2.13 |
| | Ti | 0.19 | 1.40 | 3.84 |
| TENCEL ® | None | 2.96 | 5.97 | 6.30 |
| | Ti/Zr | 1.19 | 4.52 | 8.02 |

A second set of measurements to monitor color change ratings was the AATCC Gray Scale for Color Change. The samples and the L4 blue wool standard were rated after 20 hr, 40 hr, and 60 hr light exposure. The values are shown in Table 7. After 20 hr, all samples rated 5 (no change) or 4–5 (slightly noticeable change), thus showing little color change after 20 hr exposure. The purple (Au-viscose), dark yellow (Ti-silk), light yellow (Ti-viscose), light brown (chromate-silk), and the white fabrics were given ratings of 5 or 4–5. The only exception was the white TENCEL® control fabric, which appeared to be contaminated with color prior to exposure. The fabric samples showing the most color change after 60 hr exposure were the viscose, colored with titanium to light yellow, and the TENCEL®, colored with titanium and zirconium to light orange. However, as seen in Table 7, overall the fabrics were quite resistant to photobleaching.

TABLE 7

AATCC Gray Scale for Color Changes on Exposure to Light

| Fabric | Micro-particle | Color | 20 Hour | 40 Hour | 60 Hour |
|---|---|---|---|---|---|
| Silk | None | White | 4–5 | 3–4 | 4 |
| | Cr | Lt. Brown | 4–5 | 3–4 | 4 |
| | Ti | Dk. Yellow | 4 | 3–4 | 3–4 |
| Viscose | None | White | 4–5 | 3–4 | 4 |
| | Au | Purple | 4–5 | 4–5 | 4–5 |
| | Pt | White | 5 | 3–4 | 3–4 |
| | Ti | Lt. Yellow | 5 | 4 | 3 |
| TENCEL ® | None | White | 3 | 2 | 2 |
| | Ti/Zr | Lt. Orange | 4–5 | 2–3 | 2 |
| Blue Wool Standard | None | Blue | 4 | 4 | 4 |

Finally, the fabrics were measured for color strength using a spectrophotometer to generate the K/S value, which is the ratio of radiation absorbance to light scattering at a given wavelength, 540 nm. K/S values were taken before light exposure and then at 20 hr, 40 hr and 60 hr light exposure. The values are shown in Table 8. In most samples, the K/S values for all exposure times are close to the pre-exposure value. This is further indication that the fabrics were colorfast after exposure for up to 60 hr of light. The greatest change in K/S values was seen for TENCEL® colored with titanium and zirconium. The results from the K/S measurements further support the results seen from CIELAB color differences and gray scale ratings.

TABLE 8

K/S Values - Fabrics Exposed to Light

| Fabric | Treatment | 0 Hour | 20 Hour | 40 Hour | 60 Hour |
|---|---|---|---|---|---|
| Silk | None | 0.0743 | 0.0876 | 0.0932 | 0.0893 |
| | Cr | 4.7906 | 4.8170 | 4.8975 | 5.1823 |
| | Ti | 9.2079 | 9.6168 | 10.1336 | 9.6950 |
| Viscose | None | 0.1113 | 0.0980 | 0.0960 | 0.0872 |
| | Au | 4.251 | 4.6070 | 4.2715 | 4.2078 |
| | Pt | 0.1087 | 0.0958 | 0.0836 | 0.0741 |
| | Ti | 0.5860 | 0.5740 | 0.5124 | 0.4051 |
| TENCEL ® | None | 0.1884 | 0.1383 | 0.1068 | 0.0884 |
| | Ti/Zr | 1.5893 | 1.5112 | 1.2836 | 1.0121 |

EXAMPLE 10

Colorfastness to Chemical Bleaching

Silk habutae (style #609) was used to test colorfastness to bleach. One sample of silk was colored using gold with tannic acid as described in Example 2. A second sample was left untreated. Portions of each sample were cut and immersed in undiluted sodium hypochlorite bleach solution (CHLOROX®) at ambient temperature for 10 min. Then each was rinsed in distilled water, dried, and examined for the effects of the bleach. The uncolored control silk had turned yellow, while the gold-colored sample visually appeared only slightly darker in color. The samples were then measured for color changes using the AATCC Gray scale as described in Example 7. According to the AATCC Grey scale, the bleach effect on the gold-colored silk was a value of two, while the effect of the bleach on the control silk was below the recordable range. The bleach altered the color of the control silk substantially more than the bleach altered the color of the gold-colored silk.

From the results of the above experiments, it would be apparent to a person of ordinary skill in the art that with variations in the transition metals or the compounds used, the solvents, and modifications of the reaction conditions, a variety of desirable colors can be obtained, and a wide range of fibers can be colored by this method of in situ micro-particle formation, including fibers that form textiles and paper. From the theory of the method explained here, it is clear that nearly any fiber can be colored using this method, so long as a nucleating agent can be attached to the fiber. This method will work for any transition metal or compound thereof that is sufficiently soluble and that will undergo reduction by the nucleating agent attached to the fiber.

It will be also be apparent to one skilled in the art that these methods could be applied to many soluble elements and ion complexes in an aqueous solution, or other solvents such as alcohols, acetones, and other organic solvents.

Additionally, other nucleating agents could be used, including for example sodium citrate, sodium acetate, tannic acid, other tannins including but not limited to proanthocyanidin, formaldehyde, phosphorus, sodium malate, sodium ascorbate, sodium borohydride, acetone, acetylene, ethanol, oxalic acid, and substituted amines such as hydroxylamine and hydrazine.

The negative surface charge of colloidal gold sols can be used to add additional products to the surface of the particle. However, if left unblocked, the charge could attract cations and dirt, which could change the character of the color. For example, by reacting the gold dye with sodium ions, the color is changed to a brownish red. It may be desirable to block the surface, either by standard industry methods, or by using high molecular weight polyethylene glycol, a known blocker of gold sols, to prevent undesired binding. Agents known to be protecting agents for hydrophobic colloidal particles include polyacrylic acid hydrazide, gelatin, polyvinylpyrrolidone, casein, amorphous egg albumin, ovomucoid, polyvinylalcohol, gum arabic, chondroitin sulfate, polyacrylamide, polyacrolein, heparin, gum tragacanth, crystallized egg albumin, polyacrylic acid, sodium alginate, pepsin, polyethylenimine, trypsin, potato starch, copolymer of 4-vinylpyridine and methyl vinyl ketone, dextrin (British gum), cane sugar, and urea. See K. Park et al., 1989.

As used in the specification and Claims, the term "transition element" or "transition metal" means the elements on the periodic table from atomic number 21 through 30 (scandium through zinc), 39 through 48 (yttrium through cadmium), 57 through 80 (lanthanum through mercury), and 89 through 92 (actinium through uranium). (The transuranic elements, while theoretically usable in the present invention, would not be practical for obvious reasons.)

I claim:

1. A method for generating micro-particles in situ as an integral part of a fiber to impart a color to the entire fiber, said method comprising the steps of:

(a) first permeating the fiber with a nucleating agent; and (b) then exposing the fiber to a solution or suspension comprising at least one transition metal in oxidized form;

wherein:

(c) the concentration of the nucleating agent during said permeating step is between about 0.001% weight/volume and about 1% weight/volume;

(d) the concentration of the transition metal in solution or suspension is between about 0.001% weight/volume and about 0.1% weight/volume; and (e) the temperature, the pH, and the compositions and concentrations of the nucleating agent and of the solution or suspension are such that the nucleating agent reduces at least some of the transition metal from the solution or suspension to form micro-particles comprising at least one transition metal, wherein the micro-particles are formed as an integral part of the fiber; wherein the color of the fiber differs substantially from the color of the fiber prior to the generation of the micro-particles; and wherein the color of the fiber depends upon the transition metal or metals used in said exposing step.

2. A fiber produced by the method of claim 1.

3. A method as recited in claim 1, additionally comprising the step of treating the micro-particles with hydrogen peroxide, wherein the color of the fiber becomes substantially different from the color of the fiber prior to the treatment with hydrogen peroxide.

4. A fiber produced by the method of claim 3.

5. A method as recited in claim 1, wherein the solution or suspension comprises a solution of oxidized gold, and wherein the micro-particles comprise gold.

6. A fiber produced by the method of claim 5.

7. A method as recited in claim 1, wherein the solution or suspension comprises a solution of oxidized titanium, and wherein the micro-particles comprise titanium.

8. A fiber produced by the method of claim 7.

9. A method as recited in claim 1, wherein the solution or suspension comprises a solution of at least one oxidized transition metal selected from the group consisting of platinum, silver, iron, copper, selenium, chromium, vanadium, titanium, manganese, zirconium, ruthenium, tungsten, palladium, molybdenum, nickel, and cobalt; and wherein the micro-particles comprise at least one transition metal selected from the group consisting of platinum, silver, iron, copper, selenium, chromium, vanadium, titanium, manganese, zirconium, ruthenium, tungsten, palladium, molybdenum, nickel, and cobalt.

10. A fiber produced by the method of claim 9.

11. A method as recited in claim 1, wherein the nucleating agent comprises a reducing agent selected from the group consisting of tannic acid, proanthocyanidin, acetate, citrate, formaldehyde, phosphorus, malate, ascorbate, borohydride, acetone, acetylene, ethanol, oxalic acid, hydroxylamine, and hydrazine.

12. A fiber produced by the method of claim 11.

13. A method as recited in claim 1, wherein the nucleating agent comprises tannic acid.

14. A fiber produced by the method of claim 13.

15. A method as recited in claim 1, wherein the nucleating agent comprises acetate or citrate.

16. A fiber produced by the method of claim 15.

17. A method as recited in claim 1, wherein the solution or suspension comprises at least two different transition metals in oxidized form; and wherein the micro-particles comprise at least two different transition metals.

18. A fiber produced by the method of claim 17.

19. A method as recited in claim 1, wherein said exposing step is repeated sequentially with at least two different solutions or suspensions comprising different transition metals in oxidized form; and wherein the micro-particles comprise at least two different transition metals.

20. A fiber produced by the method of claim 19.

21. A method as recited in claim 1, additionally comprising the step of exposing the fiber to a mordant.

22. A fiber produced by the method of claim 21.

23. A method as recited in claim 21, wherein the mordant comprises polyethylenimine.

24. A fiber produced by the method of claim 23.

25. A method as recited in claim 1, wherein the nucleating agent is in aqueous solution during said permeating step, and the transition metal is in aqueous solution during said exposing step.

26. A fiber produced by the method of claim 25.

27. A method as recited in claim 1, wherein the nucleating agent is dissolved in an organic solvent during said permeating step, or the transition metal is dissolved in an organic solution during said exposing step, or both.

28. A fiber produced by the method of claim 27.

29. A method as recited in claim 1, additionally comprising the step of treating the micro-particles with a protecting agent to block any surface charge that may be present on the micro-particles.

30. A fiber produced by the method of claim 29.

31. A method as recited in claim 29, wherein the protecting agent comprises polyethylene glycol.

32. A fiber produced by the method of claim 31.

33. A method as recited in claim 29, wherein the protecting agent is selected from the group consisting of polyacrylic acid hydrazide, gelatin, polyvinylpyrrolidone, casein, amorphous egg albumin, ovomucoid, polyvinyl alcohol, gum arabic, chondroitin sulfate, polyacrylamide, polyacrolein, heparin, gum tragacanth, crystallized egg albumin, polyacrylic acid, sodium alginate, pepsin, polyethylenimine, trypsin, potato starch, copolymer of 4-vinylpyridine and methyl vinyl ketone, dextrin (British gum), cane sugar, and urea.

34. A fiber produced by the method of claim 33.

35. A method as recited in claim 1, wherein the concentration of at least one transition metal during said exposing step is about 0.01% weight/volume.

36. A fiber produced by the method of claim 35.

37. A method as recited in claim 1, wherein the concentration of the nucleating agent during said permeating step is about 0.1% weight/volume.

38. A fiber produced by the method of claim 37.

* * * * *